United States Patent [19]

Brokke et al.

[11] 4,223,848

[45] Sep. 23, 1980

[54] REEL CHANGEOVER APPARATUS FOR HIGH SPEED STRAND TAKEUP MACHINES

[75] Inventors: Bruce M. Brokke, Maricopa County; Charles E. Sprain, Yavapai County, both of Ariz.

[73] Assignee: Western Electric Company, Inc., New York, N.Y.

[21] Appl. No.: 960,412

[22] Filed: Nov. 13, 1978

[51] Int. Cl.[3] ..... B65H 54/02; B65H 67/04

[52] U.S. Cl. ..... 242/25 A

[58] Field of Search ..... 242/25 A, 18 A

[56] References Cited

U.S. PATENT DOCUMENTS

| | | | |
|---|---|---|---|
| 3,596,844 | 8/1971 | Engmann | 242/25 A |
| 3,693,898 | 9/1972 | Otani | 242/25 A |
| 3,698,652 | 10/1972 | Morikawa et al. | 242/25 A |
| 3,837,589 | 9/1974 | Johnson et al. | 242/25 A |
| 3,877,653 | 4/1975 | Foltyn et al. | 242/25 A |
| 3,911,657 | 10/1975 | Bell et al. | 57/34 R |
| 4,015,785 | 4/1977 | Ikegami et al. | 242/25 A |
| 4,044,536 | 8/1977 | Stone | 57/52 |

FOREIGN PATENT DOCUMENTS

| | | | |
|---|---|---|---|
| 1309733 | 3/1973 | United Kingdom | 242/25 A |

*Primary Examiner*—Stanley N. Gilreath

*Attorney, Agent, or Firm*—Robert B. Kennedy

[57] ABSTRACT

Reel changeover apparatus is disclosed for a high speed strand takeup machine of the type having means for rotating a pair of reels side-by-side about mutually parallel and adjacent axes. The reel changeover apparatus comprises a distributor through which strand material may be fed onto the reels mounted for movement over the reel axes, a pair of snaggers, and means for rotating the snaggers in mutual spaced, coplanar orbits adjacent a flange rim of each reel. The changeover apparatus further comprises a strand deflector mounted for movement between the reels synchronously with movement of the distributor to guide the strand material into engagement with a snagger. The strand deflector itself includes a deflector arm, a hook mounted to the deflector arm, and drive means for moving the deflector arm and hook along a path extending between the reels and traversing the snagger orbits plane at a point below the reel axes in guiding the strand material into generally right angular engagement with a rotating snagger during reel changeover.

4 Claims, 6 Drawing Figures

REEL CHANGEOVER APPARATUS FOR HIGH SPEED STRAND TAKEUP MACHINES

TECHNICAL FIELD

This invention relates to reel changeover apparatuses for high speed strand takeup machines.

BACKGROUND OF THE INVENTION

Today machines are used for winding strand material such as wire and cable onto reels at high speeds. One of these is disclosed in U.S. Pat. No. 3,877,653 which is assigned to the assignee of the present invention. This machine includes means for mounting and rotating two takeup reels side-by-side about two parallel reel axes and for alternately feeding strand material to one of the reels being rotated at high speed while the other reel is being loaded, unloaded or stationed in a standby position.

The just described machine has also included apparatus for terminating the feed of strand material to the rotating reel when it has been filled and for then transferring strand feed to the other reel. This changeover apparatus, which is sometimes referred to as strand cutover, crossover or transfer mechanism, has included a distributor through which the strand material is guided that is mounted for reciprocal movement over the reel hubs in evenly filling the reels and also for stepped movement between paths in a series of parallel paths of reciprocal travel over the two reels in effecting reel changeover. The changeover apparatus has further included a deflector arm mounted for pivotal movement about a pivot point located between and below the two reels axes of rotation, and a pair of snaggers mounted to the reel mounts adjacent one flange rim of each reel.

To effect a changeover operation an empty reel stationed aside the filling reel is first accelerated to bring the speed of its hub to the advance speed of the strand material. The distributor is then moved from a path of reciprocating travel over the reel being filled with strand to a path over and somewhat beyond the axis of the empty reel. The deflector arm is then pivoted upwardly causing it to engage the strand material being feed through the distributor onto the filling reel and to deflect it into engagement with a snagger now rotating at high speed adjacent the empty reel. Once the snagger engages the strand it severs it while holding the severed strand end of the supply source to the rotating empty reel whereupon that reel now begins to be filled. The full reel is then brought to a halt and removed from the machine and another empty reel mounted in anticipation of the next changeover operation.

Though high speed strand takeup machines of the type just described have performed well for a number of years, the reel changeover apparatus has not functioned as reliably as desired. It sometimes occurs that a changeover is missed which forces a temporary shutdown of strand feed and the takeup machine. Since high speed takeup is often the terminal operation in a series of tandem operations performed on strand material during its manufacture, this shutdown may in turn necessitate a temporary shutdown of an entire manufacturing line.

A study of the cause of changeover failures has revealed that they usually result from a snagger not making proper contact with the strand material. Under closer scrutiny it has been determined that the principle cause for this is the fact that the strand material is presented at variable angles to the rotating snaggers including acute angles such that do not allow for a clean break and snag. It is this problem to which the present invention is directed.

SUMMARY OF THE INVENTION

In one form of the invention reel changeover apparatus is provided for a high speed takeup machine having means for supporting and rotating a pair of reels side-by-side about mutually parallel and adjacent reel axes. The reel changeover apparatus comprises a distributor through which the strand material may be fed onto the reels which is mounted for movement over and to each side of the reel axes, a pair of snaggers, and means for rotating the snaggers in mutually spaced, coplanar orbits adjacent the rim of one flange of each reel. A strand deflector is mounted for movement between the reels to guide the strand material into engagement with a snagger. The strand deflector itself comprises a hook and drive means for moving the hook along a path extending between the reels and traversing the snapper orbits plane at a point below the reel axes in guiding the strand material into generally right angular engagement with a rotating snagger during reel changeover.

Other features of the invention will be readily understood from the following detailed description of a specific embodiment thereof when read in conjunction with the accompanying drawing.

DESCRIPTION OF THE PREFERRED EMBODIMENT

Figure 1:
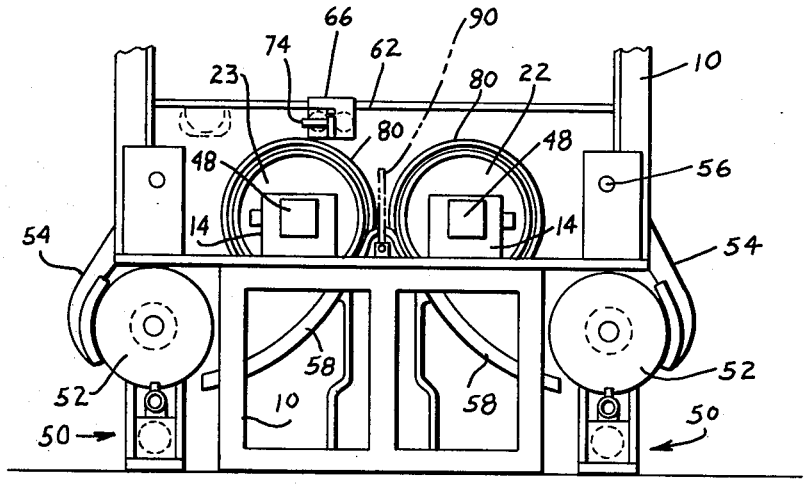
PRIOR ART Fig. 1
FIG. 1 is an end view, in elevation, of a portion of a high speed strand takeup machine and reel changeover apparatus of the prior art.
Figure 2:
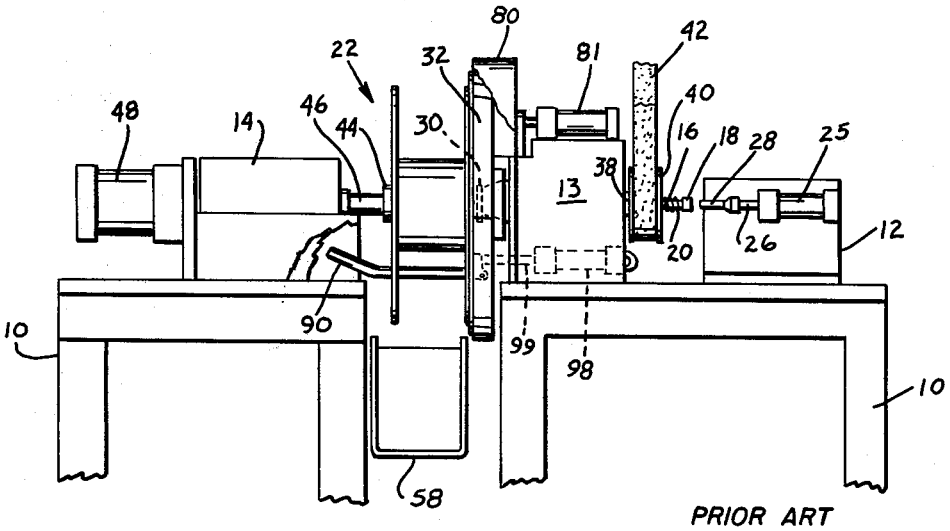
PRIOR ART Fig. 2
FIG. 2 is a side elevational view of the high speed strand takeup machine and reel changeover apparatus shown in FIG. 1.

Referring now in more detail to the drawing, there is shown in FIGS. 1 and 2 a high speed strand takeup machine comprising a frame 10 atop which is mounted a stanchion 12, and housings 13 and 14. A spindle 16 is slidably mounted within housing 13 with an enlarged end 18 projecting out from the housing. A compression spring 20 is disposed about the spindle biasing it to the right as viewed in FIG. 2.

The spindle 16 serves as an eject mechanism for a reel mounted to the takeup machine. This action is performed in conjunction with a pushoff cylinder 25 mounted to the stanchion 12 having a piston rod 26 aligned with the axis of the spindle. The piston rod has a contacting element 28 attached to its end for engaging the enlarged end 18 of the spindle and for transmitting forces from the cylinder 25 to the spindle.

Figure 4:
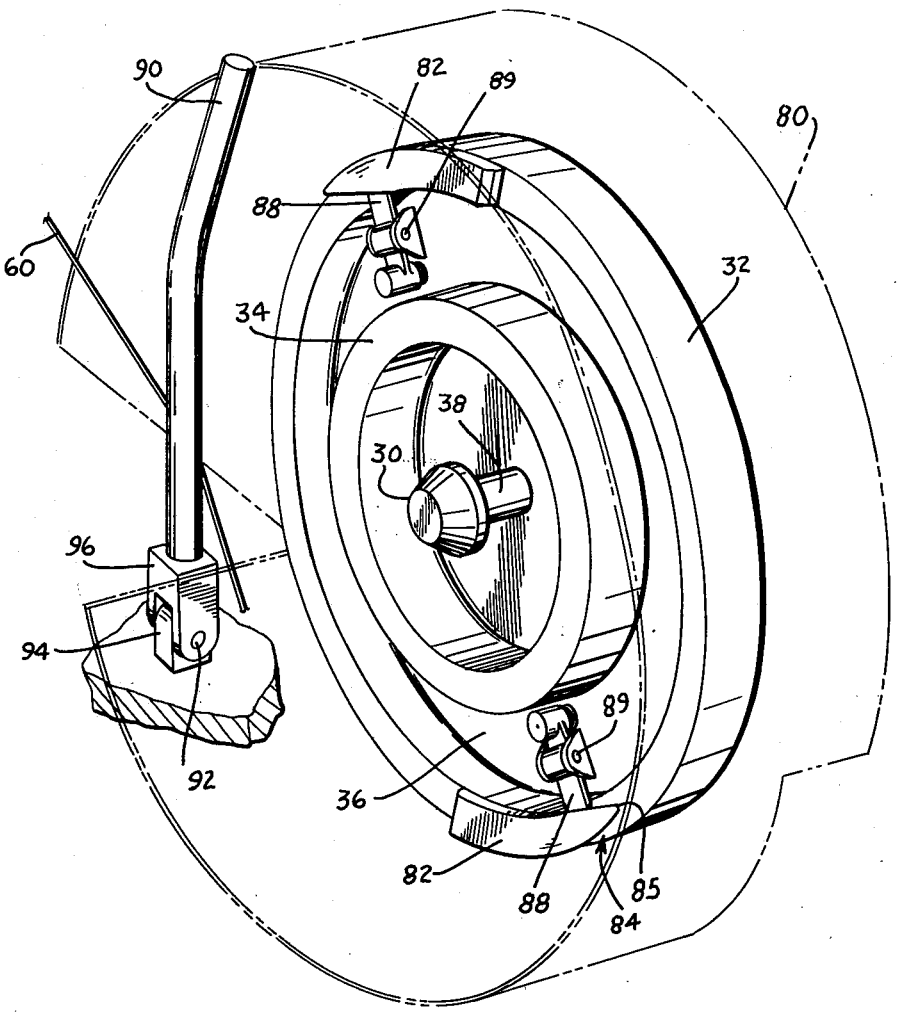
PRIOR ART Fig. 4
FIG. 4 is a perspective view of a deflector arm component of the changeover apparatus of the machine shown in FIG. 1 in association with a reel support assembly of the takeup machine.

In response to a force applied by cylinder 25 the spindle moves a first reel support one mounted to the end of shaft 38 that projects axially through a reel support and drive assembly as best shown in FIG. 4. This assembly includes a rotatable, disc-shaped plate 36, an annular pad 34 attached to the plate 36, and an annular snagger wheel or rim 32 also attached to the plate concentrically about the axis of the spindle. So constructed, when the pushoff cylinder 25 is activated to retract the piston rod 26 the contacting element 28 is disengaged from the enlarged 18 end of spindle 16 whereupon the compression spring 20 urges the spindle to the right as viewed in FIG. 2 moving the cone 30 inwardly towards plate 36 from the reel support position distal the steel plate. A reel supported on the cone and wheel assembly is thereby released. This action is performed immediately after the reel itself has been repositioned to the left in FIG. 2 directly over a ramp 58 by the combined action of cylinders 25 and 48.

A reel is rotatable about an axis of rotation by a frictional drive and wheel assembly that includes an annular pad 34 which is preferably composed of a material such as rubber cork having a high coefficient of friction. The pad is sized to abut a reel flange adjacent the support cone 30 when the reel is supported on the cone. A pulley 40 is secured to the shaft over which a belt extends for rotating the pully. A second reel support cone 44 is mounted for rotary movement coaxially the axis of the spindle 16 and the cone 30. This second cone is attached to an end of a rod 46 that extends through housing 14 and which is connected to an unshown piston rod of a reel clamping cylinder 48. Finally, an annular shroud 80 is mounted radially about the reel support and drive assembly for movement by cylinder 81 coaxially the assembly axis.

The just described reel support and drive assembly is duplicated for use in driving both a reel 22 and a reel 23 about closely adjacent and mutually parallel axis as shown in FIG. 1. Here is is also seen that two parallel conveyors 50 are provided for conveying reels 52 to and from pick-up stations located aside the strand takeup machine where reel loading arms 54 are located for pivotal movement about shafts 56 in lifting the reels from the conveyor upwardly along ramps 58 to and from the reel loaded positions occupied by reels 22 and 23.

Figure 3:
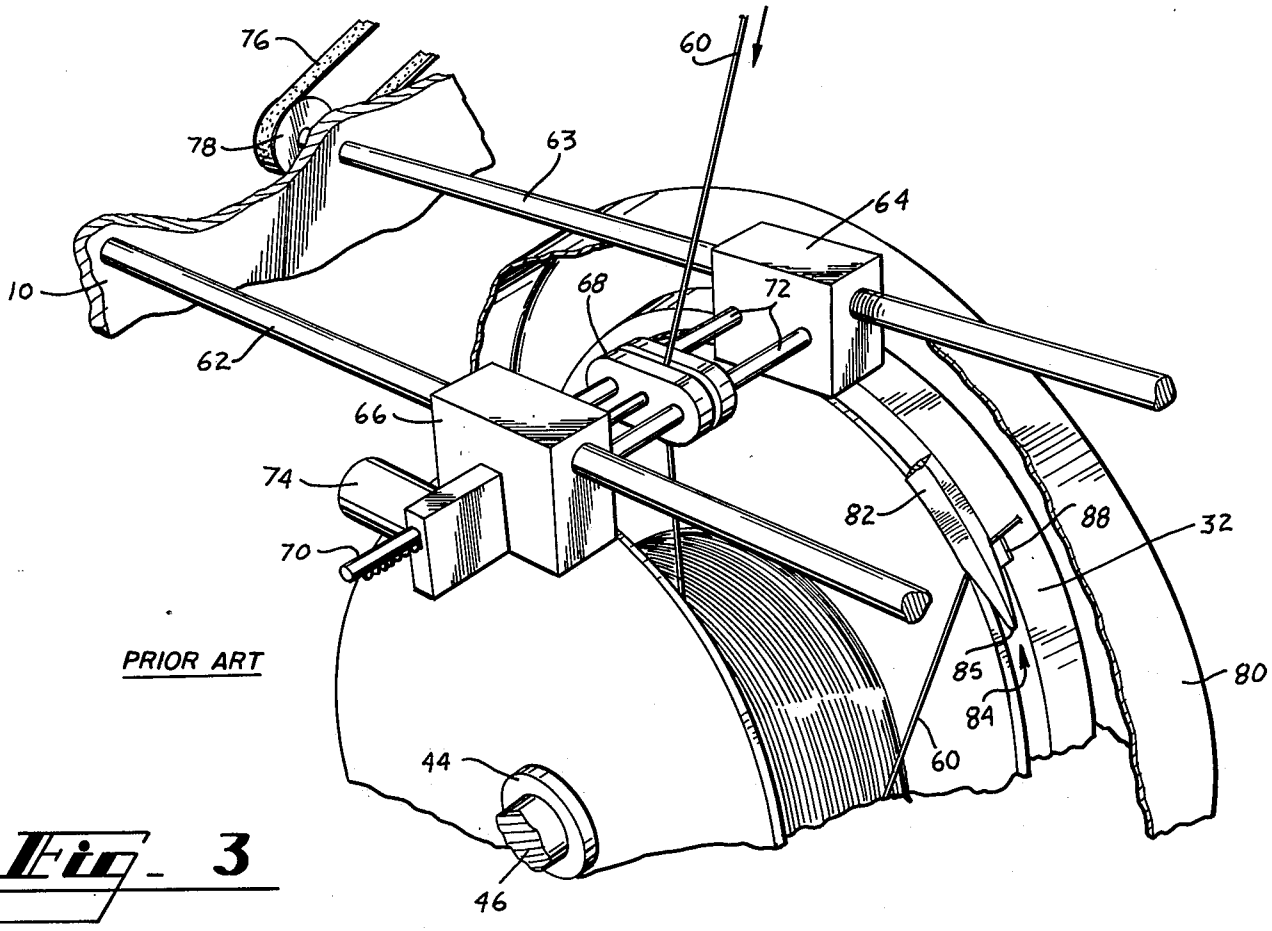
PRIOR ART Fig. 3
FIG. 3 is a perspective view of the distributor utilized in the high speed strand takeup machine shown in FIGS. 1 and 2.

With reference next to FIGS. 1 and 3 a distributor is shown for distributing strand material 60 evenly onto the reels and also for effecting reel crossover operations. The distributor includes a guide rail 62 and a lead screw 63 mounted in mutually spaced, parallel relation to the frame 10 over the reel support and drive assemblies. A block 64 is threadedly mounted upon the lead screw 63 opposite a block 66 which is slidably mounted upon the guide rail 62. A segmented distributor head 68 with rollers 69 is mounted on the end of a rack 70 for movement along a pair of guide rods 72 which span the space between blocks 64 and 66. A stepping motor 74 is mounted to the block 66 for driving the rack 70 to reciprocate the distributor head 66 over the hub of a reel supported below on the wheel assembly. The lead screw 63 itself is intermittently driven by a timing belt 76 which is passed over a pulley 78 mounted to the end of the lead screw. The timing belt is energized to relocate the distributor head during changeover operations to redirect strand material 60 from a reel approaching a full condition to an empty reel positioned adjacent thereto. This movement is synchronized with movement of the shroud 80 coaxially cones 30 and 44 during changeover while reciprocal movement of the distributor head continues over a reel hub.

With the shroud in a position radially over a wheel assembly it prevents strand material 60 being fed into a reel from becoming engaged with a component of the machine changeover apparatus in the form of a pair of snaggers 82 mounted adjacent the snagger wheel 32. Alternatively the snaggers could be mounted to a reel flange. Each snagger defines an opening 84 between a snagger tip 85 and the snagger wheel 32. Although a pair of snaggers is shown here attached to each rim, more or less than two may be employed in association with a single reel. A device 88 for releasing an end portion of the strand material from a snagger is also provided as best viewed in FIG. 4. This device includes a lever mounted for movement about a fulcrum 89. Additional details of this device as shown in the aforementioned U.S. Pat. No. 3,877,653.

The changeover apparatus of the prior art is also seen in FIG. 4 to have included a deflector arm 90 mounted for pivotal movement about a pivot pin 92 extending through a bearing 94 and clevis 96. The deflector arm is periodically pivoted upwardly and overly from the horizontal position shown in FIG. 2 to the upright position shown in FIGS. 1 and 4. This is done by a cylinder 98 and piston rod 99 to guide the strand material 60 into engagement with a snagger 82 during changeover.

Figure 5:
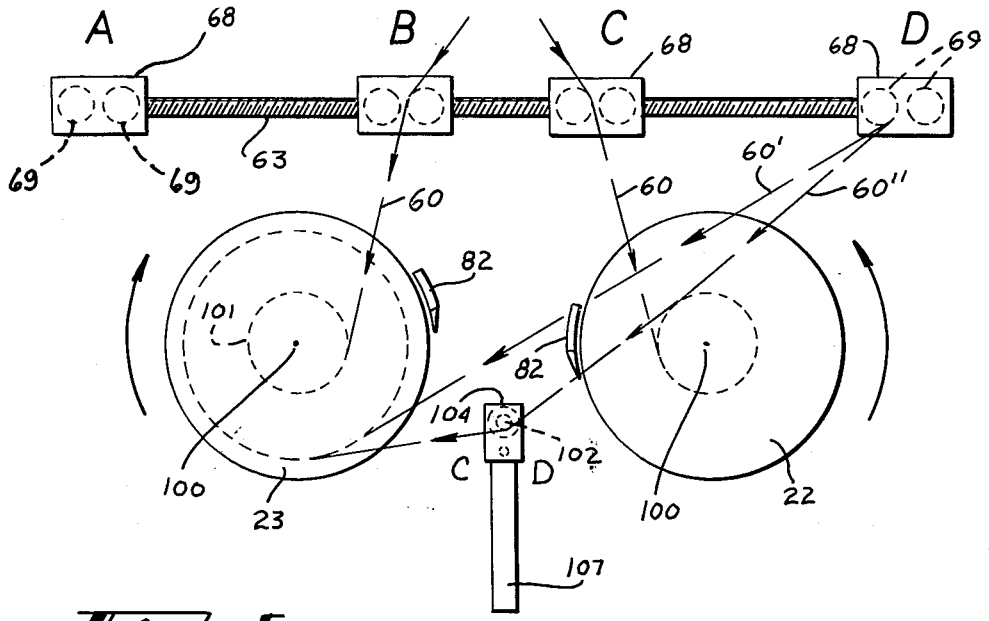
FIG. 5 is a diagrammatical end view of reel changeover apparatus of the present invention shown used in the high speed strand takeup machine shown in FIG. 1.
Figure 6:
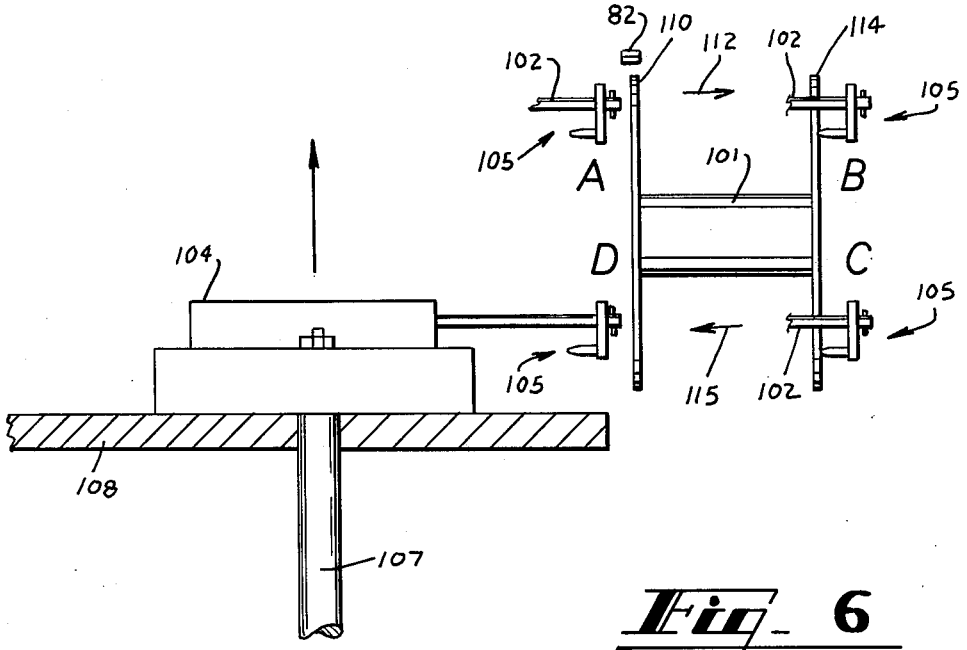
FIG. 6 is a diagrammatical side view of the reel changeover apparatus shown in FIG. 5.

With reference next to FIGS. 5 and 6 an improved changeover apparatus is shown for a high speed strand takeup machine of the type just described. Here again the changeover apparatus includes the distributor head 68 mounted upon the lead screw 63 for movement over the parallel axes 100 of rotation of the reels 22 and 23. For clarity of explanation the distributor is shown schematically in these two figures, and the terms "over" and "under" employed although the apparatus as a whole could assume any orientation. With this apparatus the pivotably mounted deflector arm 90 of the prior art has been eliminated and substituted with a deflector arm 102 which projects laterally from a cylinder 104. A hook 105 is seen to be mounted to the end of the deflector arm 102 distal the cyinder. The cylinder 104 itself is mounted atop another cylinder 107 for recipical movement in a vertical plane above a takeup baseplate 108. With this arrangement of cylinders the deflector arm and hook assembly may be moved by cylinder 104 from the position A in FIG. 6 adjacent the upper, outboard side of a reel flange 110 in the direction of arrow 112 to a position B on the upper outboard side of the other reel flange 114. The deflector arm may be moved downwardly from position B to position C by the cylinder 107 to a lower, outboard side of flange 114. From position C the deflector arm and hook may be moved by cylinder 104 in the direction of arrow 115 to the position D at a lower, outboard side of the reel flange 110. Finally, it may be raised by cylinder 107 back to position A.

The just described movements of the deflector arm 102 and hook 105 are performed synchronously with movements of the distributor head over the reels as shown in FIG. 5. In position B the distributor head 68 is located over reel 23 as strand material 60 is wound about the hub 101 of that reel. During this time the deflector arm 102 and hook 105 may be at rest at either position D or A. For crossover to reel 22 the distributor head is moved to position D and the empty reel accelerated to crossover speed. While the distributor head is in position D the deflector arm is moved through position B and then downwardly to position C thereby relocating the strand path from 60' and 60'' in FIG. 5. The shroud 80 is now moved axially away from over the wheel assembly to expose the rotating snaggers 82.

The deflector arm 102 and hook 105 are next moved from position C to position D in the direction of arrow 115. As this occurs the strand material continues to be moved reciprocally by the stepping motor 74 and rack 70 over the hubs of the two reels, sliding back and forth along the lower surface of the deflector arm. The deflector arm hook however soon forces the strand across the plane of the rotating snaggers 82. As this plane is traversed the angle of attack of the strand is generally right angularly to the travel of one of the rotating snaggers 82 as seen in FIG. 5. When the strand material is snagged it is severed at a point between the snagger and full reel 23 and thereupon wrapped about the hub of the other, empty reel 22. The full reel 23 is then brought to a halt and discharged from the machine down the ramp 58 to a conveyor 50. A new reel is then placed at the position of the discharged reel for the next changeover operation. Until this occurs the distributor occupies position C in FIG. 5 only later to move to position A for changeover to the new reel 23 in the same manner as just described.

We thus see that reel changeover apparatus is provided for a high speed strand takeup machine which provides positive action in guiding strand material and in directing it at an effective and predictable angle of attack into engagement with a snagger which provides enhance reliability of changeover operations.

It should be understood that the just described embodiment merely illustrates principles of the invention in one preferred form. Many modifications, additions and deletions may, of course, be made thereto with departure from the spirit and scope of the invention as set forth in following claims.

What is claimed is:

1. In a high speed strand takeup machine having means for supporting and for rotating a pair of reels side-by-side about mutually parallel and adjacent reel axes, reel changeover apparatus for transferring the feed strand from one reel to another which comprises, in combination, a distributor through which strand material may be fed onto the reels mounted for movement between a plurality of positions over and to each side of reel axes; a pair of snaggers; means for rotating said snaggers about the parallel reel axes in mutually spaced orbits lying in a common snagger orbits plane; and a strand deflector having a hook coupled with drive means for moving said hook along a path extending between the reel axes and traversing said common snagger orbits plane at a point below the reel axes with the path having a beginning point and an ending point, and wherein said deflector drive means further includes means for returning said hook from said path ending point to said path beginning point along a return path extending above said path and reel axes.

2. Reel changeover apparatus for a high speed strand takeup machine in accordance with claim 1 wherein said strand deflector drive means includes means for moving said hook along a linear path extending between the reel axes and traversing said common snagger orbits plane at a point below the reel axes.

3. Reel changeover apparatus for a high speed strand takeup machine in accordance with claim 1 wherein said strand deflector drive means includes means for moving said hook along a linear path extending generally parallel with the parallel reel axes and traversing said common snagger orbits plane at a point below the reel axes.

4. Reel changeover apparatus for a high speed strand takeup machine in accordance with claim 1 wherein said strand deflector has an elongated deflector arm extending from said hook along with strand material may be guided to said hook.

* * * * *